US006326573B1

(12) United States Patent
Falkingham

(10) Patent No.: US 6,326,573 B1
(45) **Date of Patent: *Dec. 4, 2001**

(54) VACUUM SWITCHING DEVICE

(75) Inventor: Leslie T Falkingham, Rugby (GB)

(73) Assignee: GEC Alsthom Limited (GB)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/025,457

(22) Filed: Feb. 18, 1998

(30) Foreign Application Priority Data

Mar. 10, 1997 (GB) ..... 9704884

(51) Int. Cl.[7] ..... H01H 33/66
(52) U.S. Cl. ..... 218/130; 218/123; 218/127
(58) Field of Search ..... 18/43, 118, 125–130

(56) References Cited

U.S. PATENT DOCUMENTS

| | | | | |
|---|---|---|---|---|
| 3,783,213 | | 1/1974 | Amoth et al. . | |
| 3,953,698 | * | 4/1976 | Luttgert et al. | 200/279 |
| 4,243,859 | * | 1/1981 | Peche | 218/118 |
| 4,348,567 | * | 9/1982 | Hruda | 218/130 |
| 4,453,054 | * | 6/1984 | Peche et al. | 218/118 |
| 4,628,164 | * | 12/1986 | Talpo | 218/125 |
| 5,354,352 | * | 10/1994 | Seki et al. | 78/245 |
| 5,687,472 | * | 11/1997 | Honma et al. | 218/136 |

FOREIGN PATENT DOCUMENTS

| | | |
|---|---|---|
| 0 155 584 | 9/1985 | (EP) . |
| 915559 | 1/1963 | (GB) . |
| 1020914 | 2/1966 | (GB) . |
| 1103619 | 2/1968 | (GB) . |
| 1121385 | 7/1968 | (GB) . |
| 1 388 700 | 3/1975 | (GB) . |
| 2 056 177 A | 3/1981 | (GB) . |

* cited by examiner

*Primary Examiner*—Lincoln Donovan
(74) *Attorney, Agent, or Firm*—Kirschstein, et al.

(57) ABSTRACT

In a vacuum switching device having first and second contacts, the first contact only is composed wholly or partly of a combination of at least a high-conductivity material and an arc-resistant material, e.g. chromuim, tungsten or tungsten carbide, and/or an anti-weld material, e.g. bismuth, antimony, tellurium or lead, while the second contact lacks the arc-resistant and anti-weld material. Metal vapor produced by the first contact during arcing is deposited on the opposing surface of the second contact to form a thin layer of high-conductivity and arc-resistant and/or anti-weld material which then dominates the properties of the arc and allows a low chopping current and/or an enhanced anti-weld performance of the contacts to be achieved without the expense of having both contacts of the same composition at manufacture.

11 Claims, 1 Drawing Sheet

VACUUM SWITCHING DEVICE

BACKGROUND OF THE INVENTION

The invention concerns a vacuum switching device, and in particular a vacuum interrupter.

Vacuum interrupters are commonly used in electrical equipment for interrupting an AC supply in the event of a fault, e.g. a short-circuit on a power line. A typical vacuum interrupter is shown in very general terms in FIG. 1. The interrupter comprises an insulator 10, normally made of a ceramic or glass material, housing two electrically conductive contacts 11, 12. Contacts 11, 12 are taken out of the interrupter unit by means of respective stems 13, 14, the stems terminating in end-portions 15, 16, normally referred to as "end-stubs", for connection to further electrical equipment (not shown). The end-stubs 15, 16 may have external or internal threads for effecting the connections. The interrupter by means of its contacts serves selectively to establish or remove electrical continuity between the further electrical equipment and the AC supply.

Also included in the interrupter is a bellows unit 17 and a shield 18. The bellows unit 17 allows axial movement of the stem 14 to make and break, as afore-mentioned, electrical contact between the contacts 11 and 12, contact 11 and stem 13 being fixed relative to the insulator 10.

The shield 18 is an electrically conductive component which serves two main purposes: to prevent an arc, which is drawn when the contacts are separated, from striking the insulator and to impede the deposition of metal vapour, which is given off from the contacts when the arc is present, on the insulator.

The arc that is drawn when the contacts are separated during the presence of a normal or a high fault-current, for example, allows the current flowing prior to the interruption to continue by the medium of metal vapour given off from the contact faces. Nominally the arc would extinguish when the current passing through the arc passed through its next zero-crossing, however a phenomenon known as "current chopping" causes the arc to cease ("chop") before that zero-crossing point by virtue of the reduction of the energy in the arc. When chopping occurs, a high voltage can be caused to appear across the contacts which is passed on to equipment (e.g. a motor load) connected to the interrupter, and if the voltage is high enough damage can be done to that equipment. There is therefore a desire to keep such voltage to as low a level as possible, which in turn means minimizing the current at which chopping occurs.

The value of the chopping current depends on the nature of the contact material and it has been found that, although an element such as copper or silver by itself gives rise to a high level of chopping current, if such a high-conductivity material is combined with an arc-resistant material such as tungsten, tungsten carbide or chromium, the chopping current can be brought down to very low levels, e.g. of the order of 4 A or less.

Use of a combination of materials for the contact instead of just the high-conductivity material considerably increases the costs of the interrupter and in an attempt to minimize such costs it is common practice to make only part of each contact of a combination of materials the remaining part being of the high-conductivity element only. The combined-material part is that part from which the arc is struck, the remaining part of each contact serving to sink heat from the arc-exposed part and to physically and electrically connect that part to the contact stem. It is clear that, since this remaining part plays no role in arc generation, it is not required to supply a vapour which has the afore-mentioned low chopping current quality, and can therefore be made exclusively of inexpensive high-conductivity material.

It is an aim of the present invention to provide a vacuum switching device which permits increased savings in contact-material outlay.

SUMMARY OF THE INVENTION

In accordance with the invention, there is provided a vacuum switching device comprising first and second contacts for making or breaking an electrical circuit, wherein said contacts each comprise a high-conductivity material and, prior to the drawing of an arc from said contacts, said first contact alone additionally comprises an arc-resistant and/or anti-weld material whereas, following the drawing of an arc from said contacts, said second contact has formed thereon a thin layer of said arc-resistant and/or anti-weld material. The first contact may be either the moving or fixed contact, as convenient.

The advantage of this construction is that, since only one contact comprises an expensive combination of materials in contrast with both contacts in prior-art arrangements, considerable savings can be made in materials outlay for the vacuum switching device, yet without significantly compromising the performance of the device. This is because in use, following the drawing of an arc from the contacts, the second contact develops its own thin layer of the arc-resistant and/or anti-weld material found in the first contact.

The high-conductivity material may be, for example, Ag or Cu, or a mixture thereof, the arc-resistant material may be selected from the group consisting of Cr and W and their carbides, or mixtures thereof, and the anti-weld material, where present, may be selected from the group consisting of Bi, Pb, Te and Sb, or mixtures thereof.

In accordance with a further aspect of the invention, there is provided a vacuum switching device having a pair of contacts for making or breaking an electrical circuit, wherein said contacts at facing ends thereof each comprise a layer composed of a high-conductivity material and an arc-resistant and/or anti-weld material, the layer of one of said contacts being a bulk layer as present in a manufactured state of said contact, whereas the layer of the other of said contacts is a vacuum-deposited layer produced by arcing between said contacts. The bulk layer may be substantially thicker than the vacuum-deposited layer.

In a yet further aspect of the invention, a method of manufacturing a vacuum switching device having first and second contact members and an insulating housing comprises the manufacture of said first contact member from a high-conductivity material and an arc-resistant and/or anti-weld material and the manufacture of said second contact member from said high-conductivity material, but excluding said arc-resistant and/or anti-weld material, and the enclosure of said contact members in said insulating housing.

BRIEF DESCRIPTION OF THE DRAWINGS

An embodiment of the invention will now be described, by way of example only, with the aid of the drawings, of which.

DETAILED DESCRIPTION OF AN EMBODIMENT OF THE INVENTION

Figure 1:
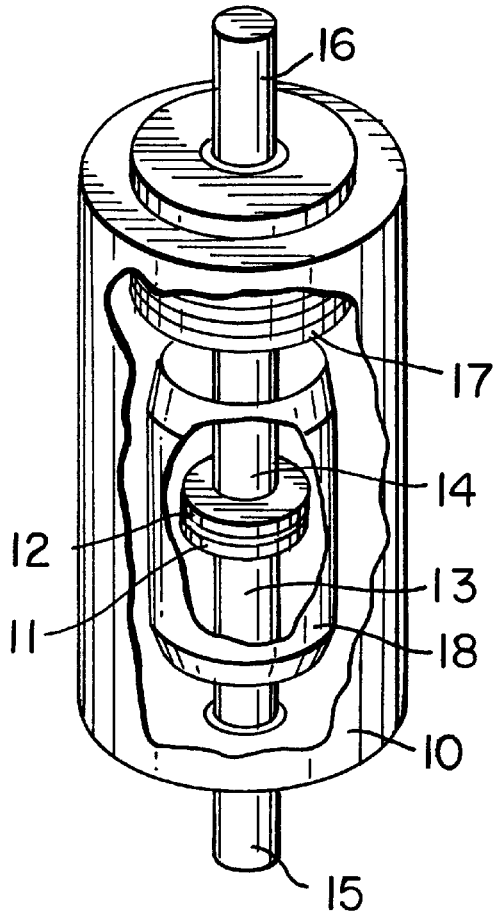
FIG. 1 PRIOR ART
FIG. 1 is a general view of a typical vacuum switching device, in accordance with the prior art
Figure 2:
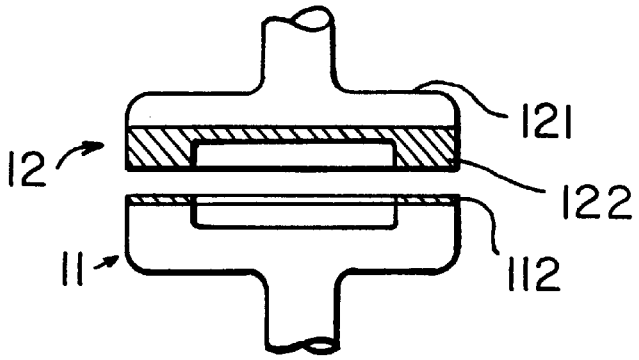
FIG. 2 is a simplified sectional view of the contacts of a vacuum switching device in accordance with the present invention.

In a vacuum switching device according to the invention, a contact 11 is composed of one piece and a contact 12 is made in two pieces 121, 122 which are welded to each other by some suitable process, e.g. brazing. The contact 11 and piece 121 are composed of copper, while the piece 122 is an alloy of Cu, Cr and Bi, the chromium acting as an arc-resistant material and the bismuth acting as an anti-weld material.

During operation of the device, when the contacts 11, 12 are separated an arc is struck between the contact faces which is formed in metal vapour given off from those faces. The invention rests on a recognition by the inventor that some of the vapour from the alloyed contact part 122 will be deposited on the opposing non-alloy contact 11 as a thin layer 112, this thin layer then dominating the properties of the arc such that the same low chopping current properties as are found in the conventional device in which both contacts comprise an alloy material, will still be available. There was the further surprising recognition that in practice very acceptable performance in terms of wear is achievable in such a device, in spite of some arc erosion in the purely high-conductive contact 11. This is because, although the wear rate of the pure Cu contact 11 is greater than that of the alloy contact part 122, especially when an arc is initially struck and during short-circuit current conditions, the real life of an interrupter in practice greatly exceeds its normally required life, so that the service life of the device according to the invention is no less than what would normally be expected of a typical conventional interrupter device.

In addition, it was found that incorporating an anti-weld material (bismuth in this example) in only one contact still gave acceptable anti-weld properties. This is due to the fact that, as long as one contact surface develops a brittle skin of material following arcing, any welding of the contacts that does occur can be readily broken.

While the alloy of the one contact has been described in terms of the addition of both an arc-resistant material and an anti-weld material to a high-conductivity material, either of these may in practice be omitted, depending on the performance characteristics required. Equally, further materials may be included as appropriate in order to achieve particular properties of the contact. Thus, for example, sintering properties may be improved by the inclusion of, for example, Co, Fe or Ni.

Also, although in the above example mention has been made of the alloyed composition of the first contact, it is clear that, depending on the nature of the materials used along with the high-conductivity material, an alloy may or may not be formed. Thus, where WC and Ag is used, for example, since WC is not soluble in Ag the resultant composition will not be an alloy but simply a combination of these materials.

It is possible to pre-arc the contacts during manufacture to ensure that the thin layer of combined materials is already present on the second contact as sold prior to use on-site, although this could be considered to be unnecessary in view of the fact that deposition of the layer occurs naturally anyway during all switching operations in service.

The alloy, or combination of materials, may be produced by the known infiltration method, in which grains of the arc-resistant material, e.g. chromium, are compacted to an approximately 60% density and then sintered at a temperature of around 1500° C. to provide a sponge-like matrix or "skeleton". The high-conductivity material, e.g. copper, is likewise compacted and then placed against the sintered matrix and melted under pressure, so that it infiltrates into the voids of the matrix. Alternatively, a pure sintering method may be employed in which both the high-conductivity and arc-resistant materials are compacted together under a much higher pressure to perhaps 99% density and then sintered.

I claim:

1. A vacuum switching device, comprising:

a) first and second contacts movable relative to each other, for making and breaking an electrical circuit, b) said first contact being of one-piece construction and being constituted of a bulk material having a predetermined conductivity, and c) said second contact being of two-piece, welded construction and having i) a bottom piece constituted of a material having said predetermined conductivity, and ii) a top piece facing said first contact and constituted of a material having a lower conductivity which is less than said predetermined conductivity, the top piece also being constituted of an anti-weld material and an arc-resistant material.

2. The device according to claim 1, wherein the bulk material of said first contact and the material of said bottom piece are selected from a group consisting of copper and silver and mixtures thereof.

3. The device according to claim 1, wherein the anti-weld material is selected from a group consisting of bismuth, lead, tellurium and antimony and mixtures thereof.

4. The device according to claim 1, wherein the arc-resistant material is selected from a group consisting of chromium and tungsten and carbides and mixtures thereof.

5. The device according to claim 1, wherein each contact has a generally planar annular face bounded by an inner annular edge and an outer annular peripheral edge.

6. A vacuum switching device, comprising:

a) first and second contacts movable relative to each other, for making and breaking an electrical circuit, b) said first contact being constituted of a bulk material having a predetermined conductivity, and a vacuum-deposited layer on the bulk material and constituted of a material having a lower conductivity which is less than said predetermined conductivity, the vacuum-deposited layer also being constituted of an anti-weld material and an arc-resistant material, and c) said second contact being of two-piece, welded construction and having i) a bottom piece constituted of a material having said predetermined conductivity, and ii) a top piece facing said vacuum-deposited layer and constituted of said lower conductivity material, said anti-weld material and said arc-resistant material.

7. The device according to claim 6, wherein the bulk material of said first contact and the material of said bottom piece are selected from a group consisting of copper and silver and mixtures thereof.

8. The device according to claim 6, wherein the anti-weld material is selected from a group consisting of bismuth, lead, tellurium and antimony and mixtures thereof.

9. The device according to claim 6, wherein the arc-resistant material is selected from a group consisting of chromium and tungsten and carbides and mixtures thereof.

10. The device according to claim 6, wherein the vacuum-deposited layer is a thinly deposited layer of material vaporized from the top piece of said second contact and has an identical constituency with the material of the top piece.

11. The device according to claim 6, wherein each contact has a generally planar annular face bounded by an inner annular edge and an outer annular peripheral edge, and wherein the vacuum-deposited layer is on the face of the second contact.

* * * * *